US011197522B2

(12) United States Patent
Hall

(10) Patent No.: US 11,197,522 B2
(45) Date of Patent: Dec. 14, 2021

(54) MODULAR JEWELRY SYSTEM

(71) Applicant: Zia Rose, LLC, Jupiter, FL (US)

(72) Inventor: Gina Hall, Jupiter, FL (US)

(73) Assignee: ZIA ROSE, LLC, Jupiter, FL (US)

( * ) Notice: Subject to any disclaimer, the term of this patent is extended or adjusted under 35 U.S.C. 154(b) by 133 days.

(21) Appl. No.: 16/508,978

(22) Filed: Jul. 11, 2019

(65) Prior Publication Data

US 2020/0146405 A1 May 14, 2020

Related U.S. Application Data

(60) Provisional application No. 62/766,974, filed on Nov. 13, 2018.

(51) Int. Cl.
*A44C 25/00* (2006.01)
*A44C 17/02* (2006.01)

(52) U.S. Cl.
CPC ..... *A44C 17/0208* (2013.01); *A44C 25/007* (2013.01)

(58) Field of Classification Search
CPC ..... A44C 17/0208; A44C 25/007; A44C 17/0216; A44C 17/0233; A44C 17/0258; A44C 17/0266; A44C 7/002; F16B 5/0266; F16B 5/0275; F16B 21/073; F16B 21/02; F16B 2200/403; Y10T 24/28
USPC ..... 24/DIG. 58, DIG. 57, DIG. 53, DIG. 60
See application file for complete search history.

(56) References Cited

U.S. PATENT DOCUMENTS 3,487,512 A * 1/1970 Marosy ..... F16G 11/00 24/573.11
5,456,095 A * 10/1995 Tawil ..... A44C 17/0216 24/574.1
2015/0059403 A1* 3/2015 Fogel ..... A44C 9/0007 63/15.1
2019/0045891 A1* 2/2019 Yep ..... A44C 9/00

* cited by examiner

*Primary Examiner* — Jack W Lavinder
(74) *Attorney, Agent, or Firm* — McHale & Slavin, P.A.

(57) ABSTRACT

The invention involves a modular jewelry system and method for constructing a modular jewelry system. The system includes a base having a bore, the side wall of the bore including a groove having a slight helix. The helix includes a small protrusion beyond which the helix flattens and the slot ends. A charm, stone or the like, has an outwardly extending stem; the stem including at least one outwardly extending tab. The tab is sized to cooperate with the groove, so that the stem is pulled into the bore as the stem is rotated until passing the protrusion, whereby the stem is locked into position in the bore.

12 Claims, 7 Drawing Sheets

MODULAR JEWELRY SYSTEM

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/766,974, entitled "INTERLOCKING/INTERCHANGEABLE JEWELRY", filed Nov. 13, 2018. The contents of the above referenced application is incorporated herein by reference in its entirety.

FIELD OF INVENTION

The present invention generally relates to jewelry; and more particularly, to a jewelry system that allows the user to use a single jewelry charm or setting on multiple pieces of jewelry, or interchange jewelry components to create user designed jewelry.

BACKGROUND INFORMATION

The wearing of personalized jewelry is very popular. However, the cost of adding a personal touch, or personality, to jewelry typically requires one to incur the expense of a jewelry designer to create a customized piece of jewelry to an individual's unique specifications. This process is very expensive. There is thus a need for a jewelry invention which allows the individual an easy and desirable method and apparatus for acquiring and wearing personalized, custom jewelry, which can subsequently be reconfigured by the individual. There is further a need for a jewelry system which offers an individual greater flexibility and easy interchangeability of jewelry charms, providing combinations of metals and gemstones within the various jewelry forms, including but not limited to earrings, necklaces, bracelets, anklets, pendants, pins, broaches, belts, bands and rings.

Known interchangeable jewelry utilizes helical threads and bent wires to hold the portions of the jewelry together. The small fine helical threads and the small components that forms the jewelry are difficult to assemble, and the soft materials that form the metal components of the jewelry are easily deformed by cross threading, thereby ruining the jewelry for its intended use. Likewise, the bent wires are easily deformed and broken. Thus, what is needed is a modular jewelry system that is easily interchanged without deformation or damage to the component parts.

Finally, there are ergonomic needs that a modular jewelry mounting system must satisfy in order to achieve acceptance by the end user. The modular jewelry system must be easily and quickly assembled using minimal hardware and requiring a minimal number of tools. Further, the modular jewelry system should not require excessive strength to assemble or include small component parts. Moreover, the modular jewelry system must assemble together in such a way so as not to detract from the aesthetic appearance of the assembled jewelry.

Thus, the present invention provides a modular jewelry system that includes interchangeable components which overcomes the disadvantages of prior art jewelry systems. The modular jewelry system of the present invention not only provides for relative ease of assembly, it also permits creation of customized jewelry without the need to consult a jeweler. The present invention also provides a modular jewelry system which utilizes robust components, thereby eliminating the need for extreme precision to assemble the component parts.

SUMMARY OF THE INVENTION

Briefly, the invention involves a modular jewelry system and method for constructing a modular jewelry system. The system includes a base having a bore, the side wall of the bore including a slot having a slight helix. The helix includes a small protrusion beyond which the helix flattens and the slot ends. A charm, stone, or the like has an outwardly extending stem; the stem including an outwardly extending tab. The tab is sized to cooperate with the slot so that the stem is pulled into the bore as the stem is rotated until passing the protrusion, whereby the stem is locked into position in the bore. Removal requires the stem to be rotated in an opposite direction.

Accordingly, it is an objective of the present invention to provide a modular jewelry system.

It is a further objective of the present invention to provide a modular jewelry system having interchangeable components.

It is yet a further objective of the present invention to provide a modular jewelry system wherein the components can be interchanged by the user.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
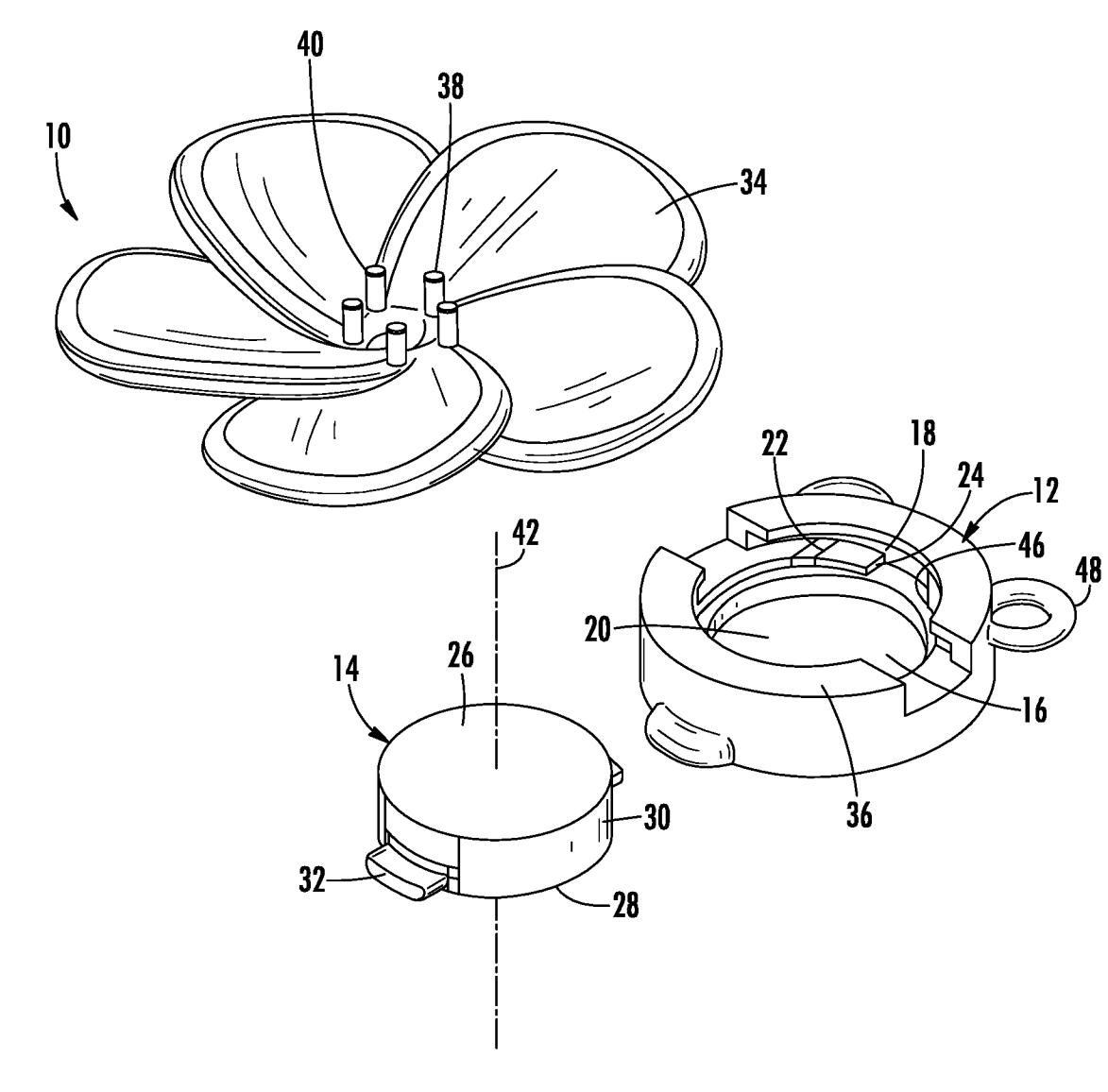
FIG. 1 is a top perspective view of one embodiment of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
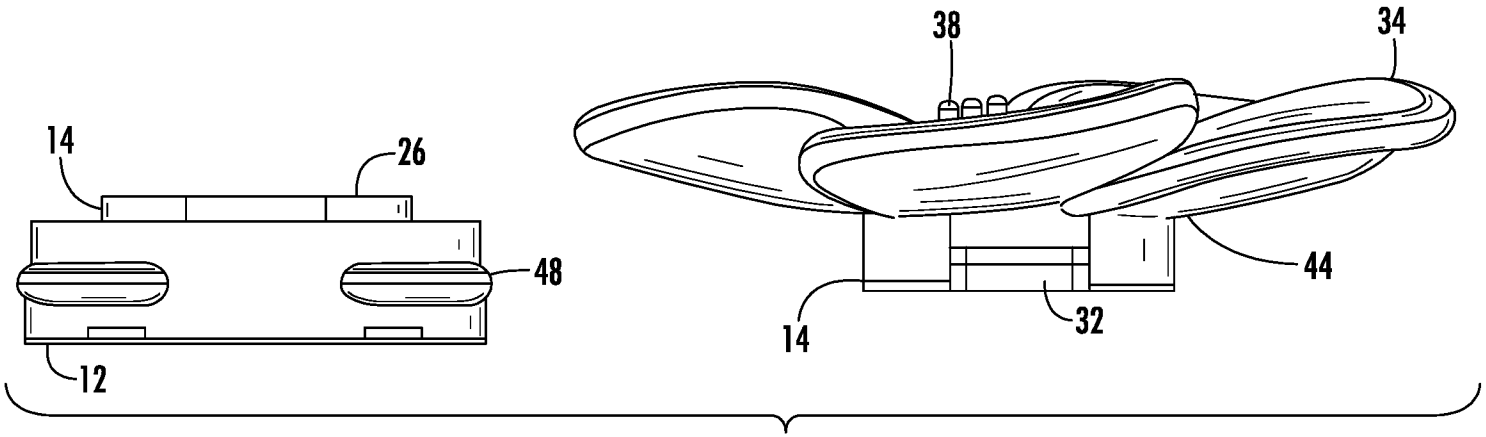
FIG. 2 is a side view of the embodiment shown in FIG. 1.
Figure 3:
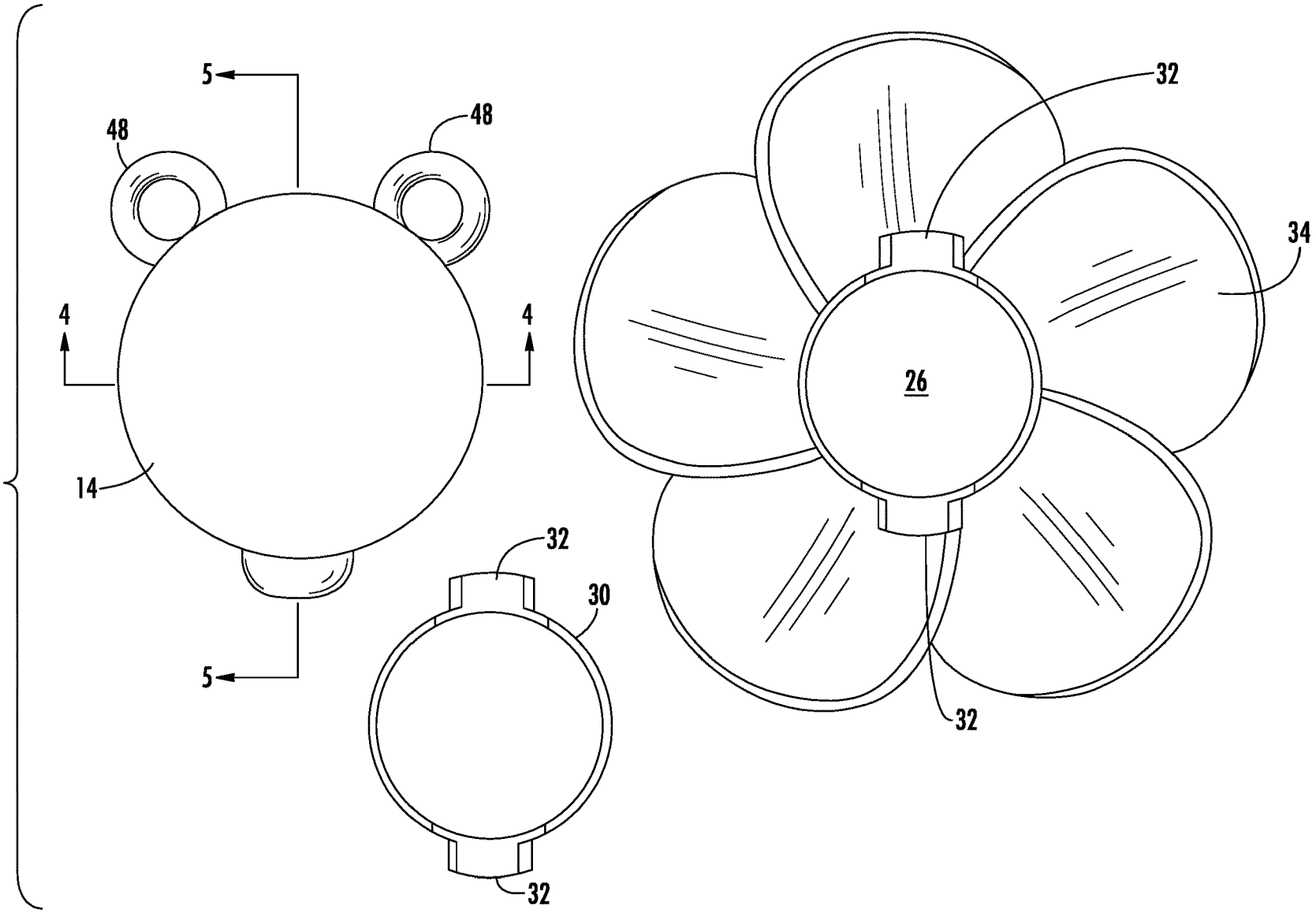
FIG. 3 is a bottom view of the embodiment shown in FIG. 1.
Figure 4:
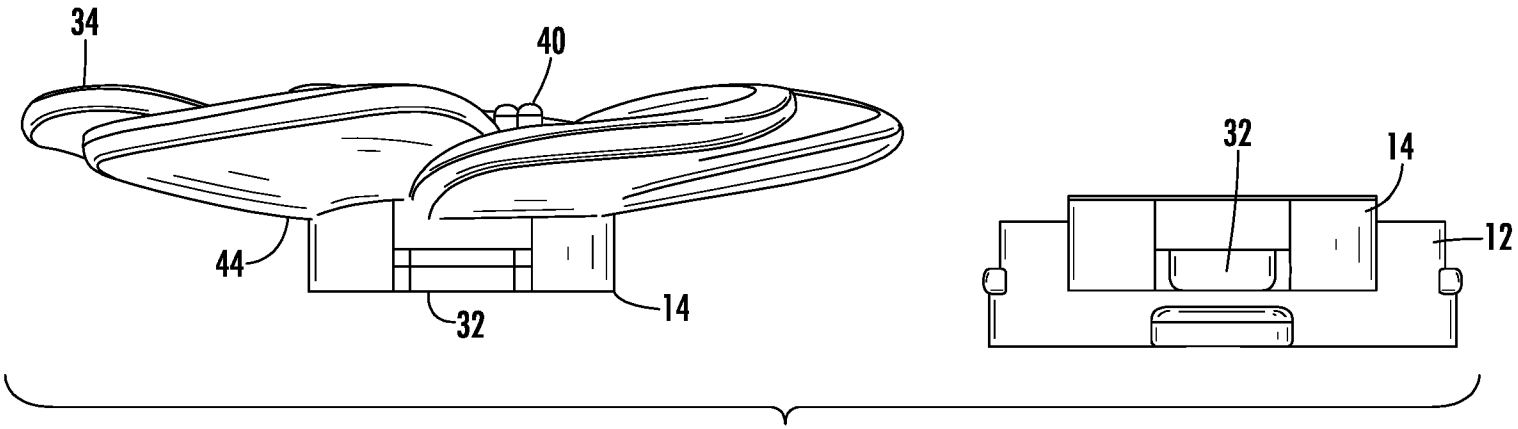
FIG. 4 is a side view, partially in section, taken along line 4-4 of FIG. 3.
Figure 5:
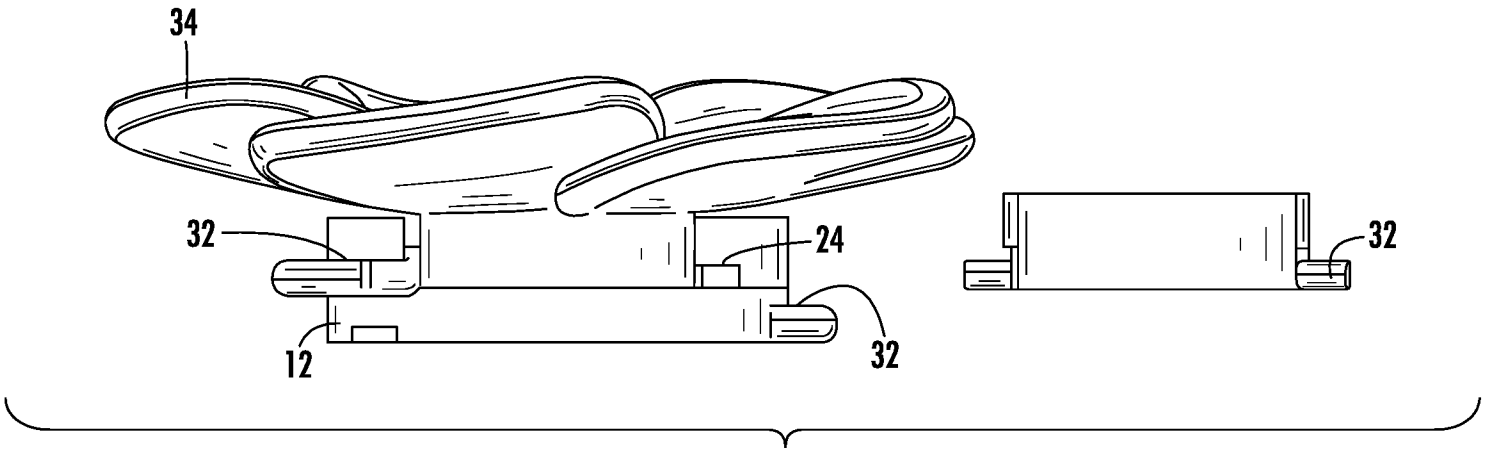
FIG. 5 is a side view, partially in section, taken along line 5-5 of FIG. 3.
Figure 6:
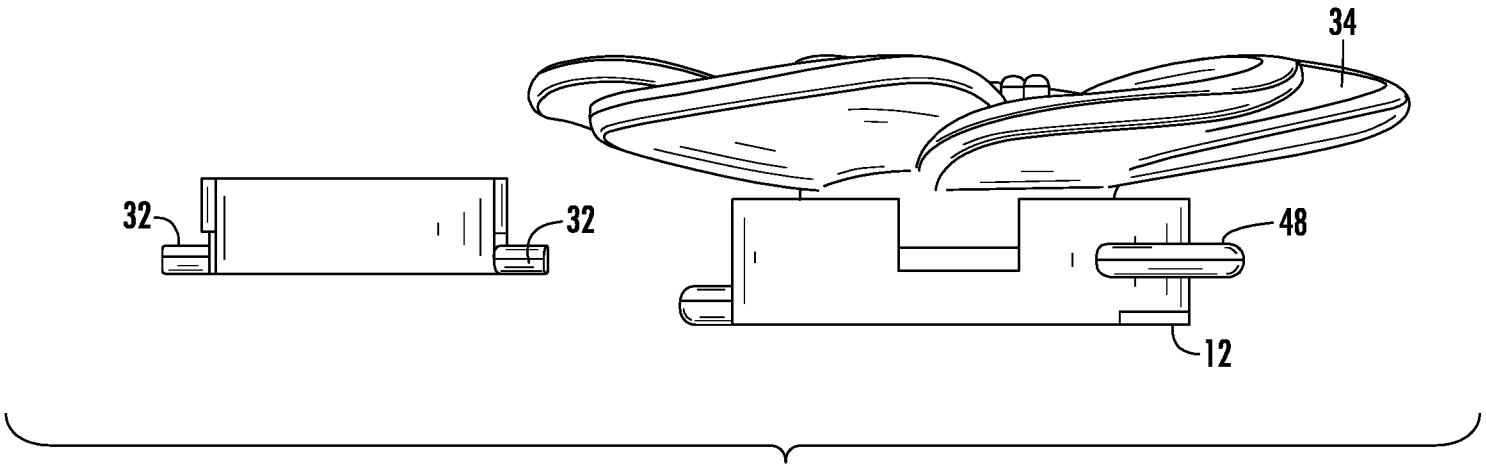
FIG. 6 is a side view of the embodiment illustrated in FIG. 1.
Figure 7:
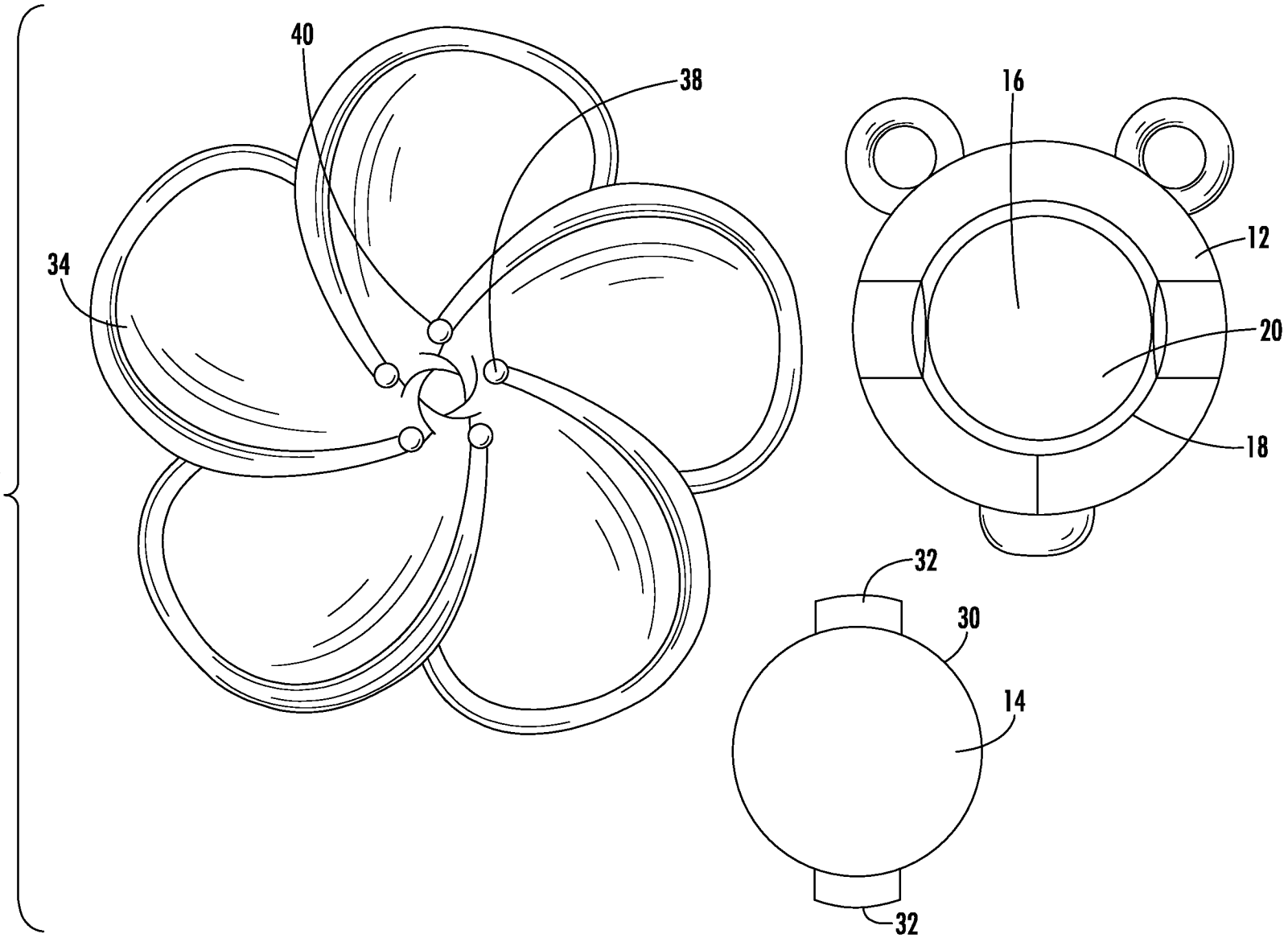
FIG. 7 is a top view of the embodiment illustrated in FIG. 1.

Referring generally to FIGS. 1-7, a modular jewelry system 10 for allowing a jewelry user to change and customize a piece of jewelry is illustrated. The system includes a base 12, and a stem 14. The base 12 has a bore 16; the bore having a side wall 18 and a bottom wall 20. The side wall 18 is preferably cylindrical in shape, including a helical groove 22 extending partially around and along the side wall 18; the helical groove 22 including a small protuberance 24, with the helical groove 22 extending past the protuberance 24.

The stem 14 has a first end 26 and a second end 28; the first end 26 having an outer diameter 30 sized and shaped to fit within the bore 16 of the base 12. The stem 14 includes at least one, and more preferably, two or more, tabs 32 extending outwardly from the outer diameter 30. The tab(s) 32 are sized to slidably fit within the helical groove(s) 22 so that, as the stem 14 is rotated, the tab(s) follow the helical groove 22 into the base 12 until the tab(s) pass the protuberance 24. The protuberance 24 provides resistance to the tab 32 passing to hold the stem in position within the helical groove 22 and thus the base 12. In this manner, vibration and normal forces applied to the stem 14 through a charm or other decorative form 34 are prevented from causing the release of the stem 14 from the base 12. The protuberance may extend into the groove 22 from any desired angle suitable to provide the resistance needed to prevent the stem from becoming inadvertently dislodged. The assembly may also include a spring in the form of a coil spring, leaf spring, or Bellville washer spring (not shown) positioned between the first end of the stem and the bottom wall of the base 12 to provide a force between the two members to provide additional resistance to the stem being removed from the base. Removal would require the user to press the stem further into the base and rotate the stem past the protuberance to remove the stem from the case. The decorative form 34 may be constructed from the same material as said second end 28 of said stem 14, or from a different material or materials. The decorative form, while illustrated as a flower, may take any desired form without departing from the scope of the invention. The stem 14 preferably includes sufficient length to extend outward from a front surface 36 of the base 12. In the preferred embodiment, the decorative form 34 is constructed from a precious metal such as gold or platinum.

The decorative form 34 may extend radially as desired, as long as the interface between the stem 14 and the base 12 is sufficient to prevent the inadvertent dislodgement of the stem 14 from the base 12. Gem mounts 38, and the like, may be secured to the decorative form 34 or directly to the stem 14 without departing from the scope of the invention. The gem mounts 38 may be constructed as upstanding posts 40, or any other suitable stone mount known in the art of jewelry. It should also be noted that other non-precious metals or materials that are suitable for jewelry construction may be utilized without departing from the scope of the invention.

In at least one embodiment, the stem 14 includes two or more tabs 32, and the base 12 includes two or more helical grooves 22, the tabs 32 and grooves 22 positioned radially about a longitudinal centerline 42 of the stem 14, so that the tabs 32 and the helical grooves 22 are aligned to slidably cooperate with each other. The tabs 32 and grooves 22 are preferably equidistantly spaced with respect to each other. However, any spacing that is suitable may be utilized without departing from the scope of the invention. In at least one embodiment, at least one of the tabs 32 and the helical grooves 22 are positioned at different heights with respect to the longitudinal centerline 42 of the stem 14. This construction provides additional resistance to the stem 14 becoming dislodged from the base 12, and prevents the stem 14 from be pulled to one side of the base 12 by external forces during use.

The tabs 32 preferably extend about five degrees of the radial circumference of a circle formed by the outer diameter of the tab 32. However, in other embodiments, the tab 32 may extend anywhere from the five degrees to forty-five degrees of the radial circumference of a circle formed by the outer diameter of the tab 32 without departing from the scope of the invention. It should also be noted that in at least one embodiment, the helical groove 22 becomes a radial groove 46 after the protuberance 24. This construction allows a shoulder 44 to be formed at the second end 28 of the stem 14. The shoulder 44 can then abut a top surface 36 of the base 12. This construction provides additional support to the stem 14, and prevents the stem 14 from being tipped or forced to one side of the base 12. The base 12 may include loops 48, pins or clasps (not shown), and may be secured to a broach, ring, necklace or any other suitable means to secure the base to a person or their clothing without departing from the scope of the invention.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A modular jewelry system for securing a charm with a stem to a base structure comprising:

a base, said base having a bore, said bore including a side wall and a bottom wall, said side wall including a groove defined by a flat upper surface, an inner side surface and a helical bottom surface extending partially around and along said side wall, said helical bottom surface having a protuberance at a distal end of the helical bottom surface, the protuberance terminates at an end to transition the groove into a wider radial groove with a radial bottom surface extending past said protuberance, said stem having a first end and a second end, said first end having an outer diameter sized and shaped to fit within said bore of said base, said stem including a tab extending outwardly from said outer diameter, said tab sized to slidably fit within said groove, so that as said stem is rotated, a top surface of said tab follows said flat upper surface of said groove into said base, said tab passing said end of said protuberance providing resistance to said tab to hold said tab in position within said groove.

2. The modular jewelry system of claim 1, wherein said second end of said stem includes a decorative form constructed from the same material as said second end of said stem, said second end having sufficient length to extend outward from a front surface of said base.

3. The modular jewelry system of claim 2, wherein said decorative form of said second end of said stem extends radially outward from said stem forming a shoulder, the shoulder abutting a top surface of the base to prevent vertical movement of the stem within the base.

4. The modular jewelry system of claim 3, wherein the shoulder, the stem and the tab cooperate to prevent tipping of the stem with respect to the base.

5. The modular jewelry system of claim 2, wherein said second end of said stem includes a stone mount for securing a gemstone to said second end of said stem.

6. The modular jewelry system of claim 1, wherein said stem includes two or more said tabs and said base includes two or more said grooves, said tabs and said grooves positioned radially about a longitudinal centerline of said stem, said tabs and said grooves aligned to slidably cooperate with each other.

7. The modular jewelry system of claim 6, wherein at least one of said tabs and said grooves are positioned at different heights with respect to said longitudinal centerline of said stem.

8. The modular jewelry system of claim 1, wherein each said tab extends about five degrees of the radial circumference of a circle formed by an outer diameter of said tab.

9. The modular jewelry system of claim 1, wherein each said tab extends about ten degrees of the radial circumference of a circle formed by an outer diameter of said tab.

10. The modular jewelry system of claim 1, wherein each said tab extends less than thirty degrees of the radial circumference of a circle formed by an outer diameter of said tab.

11. The modular jewelry system of claim 1, wherein each said tab extends less than forty-five degrees of the radial circumference of a circle formed by an outer diameter of said tab.

12. A modular jewelry system for securing a charm with a stem to a base structure comprising:

a base, said base having a bore, said bore including a side wall and a bottom wall, said side wall including at least two grooves positioned at different heights with respect to each other, each groove extending partially around and along the side wall, each groove defined by a flat upper surface, an inner side surface and a helical bottom surface, each said helical bottom surface having a protuberance at a distal end of the helical bottom surface, the protuberance terminates at an end to transition the groove into a wider radial groove with a radial bottom surface extending past said protuberance, said stem having a first end and a second end, the first end having an outer diameter sized and shaped to fit within the bore of the base, the stem including at least two tabs extending outwardly from the outer diameter, each tab positioned at a different height along the length of the stem corresponding to the grooves, each tab sized to slidably fit within a respective groove so that as the stem is rotated, a top surface of each said tab follows the respective said flat upper surface of the respective said groove into said base, at least one of the tabs passing an end of one of said protruberances providing resistance to said tab to hold said tab in position within said groove to hold the stem in position with respect to the base.

* * * * *